US009458976B2

(12) United States Patent
Krenn et al.

(10) Patent No.: US 9,458,976 B2
(45) Date of Patent: Oct. 4, 2016

(54) LIGHTING DEVICE FOR A MOTOR VEHICLE

(71) Applicant: ZIZALA LICHTSYSTEME GMBH, Wieselburg (AT)

(72) Inventors: Irmgard Krenn, Purgstall/Erlauf (AT); Clemens Hauer, Steinakirchen am Forst (AT)

(73) Assignee: ZIZALA LICHTSYSTEME GMBH, Wieselburg (AT)

( * ) Notice: Subject to any disclaimer, the term of this patent is extended or adjusted under 35 U.S.C. 154(b) by 30 days.

(21) Appl. No.: 14/413,945

(22) PCT Filed: Jun. 25, 2013

(86) PCT No.: PCT/AT2013/050129

§ 371 (c)(1),
(2) Date: Jan. 9, 2015

(87) PCT Pub. No.: WO2014/008523

PCT Pub. Date: Jan. 16, 2014

(65) Prior Publication Data

US 2015/0204503 A1 Jul. 23, 2015

(30) Foreign Application Priority Data

Jul. 11, 2012 (AT) ..... A 50278/2012

(51) Int. Cl.
*F21S 8/10* (2006.01)
*F21V 14/04* (2006.01)
*F21Y 101/02* (2006.01)

(52) U.S. Cl.
CPC ..... *F21S 48/1757* (2013.01); *F21S 48/1104* (2013.01); *F21S 48/1159* (2013.01);
(Continued)

(58) Field of Classification Search
CPC . F21V 14/04; F21S 48/1104; F21S 48/1159; F21S 48/137; F21S 48/1742; F21S 48/1747; F21S 48/1752; F21S 48/1757; F21S 48/321; F21S 48/328; F21S 48/1305
USPC ..... 362/514, 515
See application file for complete search history.

(56) References Cited

U.S. PATENT DOCUMENTS 7,600,904 B2 * 10/2009 Takada ..... F21S 48/1757 362/277
7,618,174 B2 * 11/2009 Yasuda ..... B60Q 1/076 362/512

(Continued)

FOREIGN PATENT DOCUMENTS

DE 20 2007 018 181 U1 5/2008
DE 102007040728 A1 3/2009

(Continued)

OTHER PUBLICATIONS

Zizala Lichtsysteme Gmbh, Written Opinion of The International Searching Authority (English), PCT/AT2013/050129, Jun. 25, 2013.*

(Continued)

*Primary Examiner* — Alan Cariaso
(74) *Attorney, Agent, or Firm* — Sutherland Asbill & Brennan LLP

(57) ABSTRACT

The invention relates to a lighting device (1) for a motor vehicle, comprising at least one light unit (2), for example two or more light units (2), wherein each light unit (2) comprises:

Figure 1:
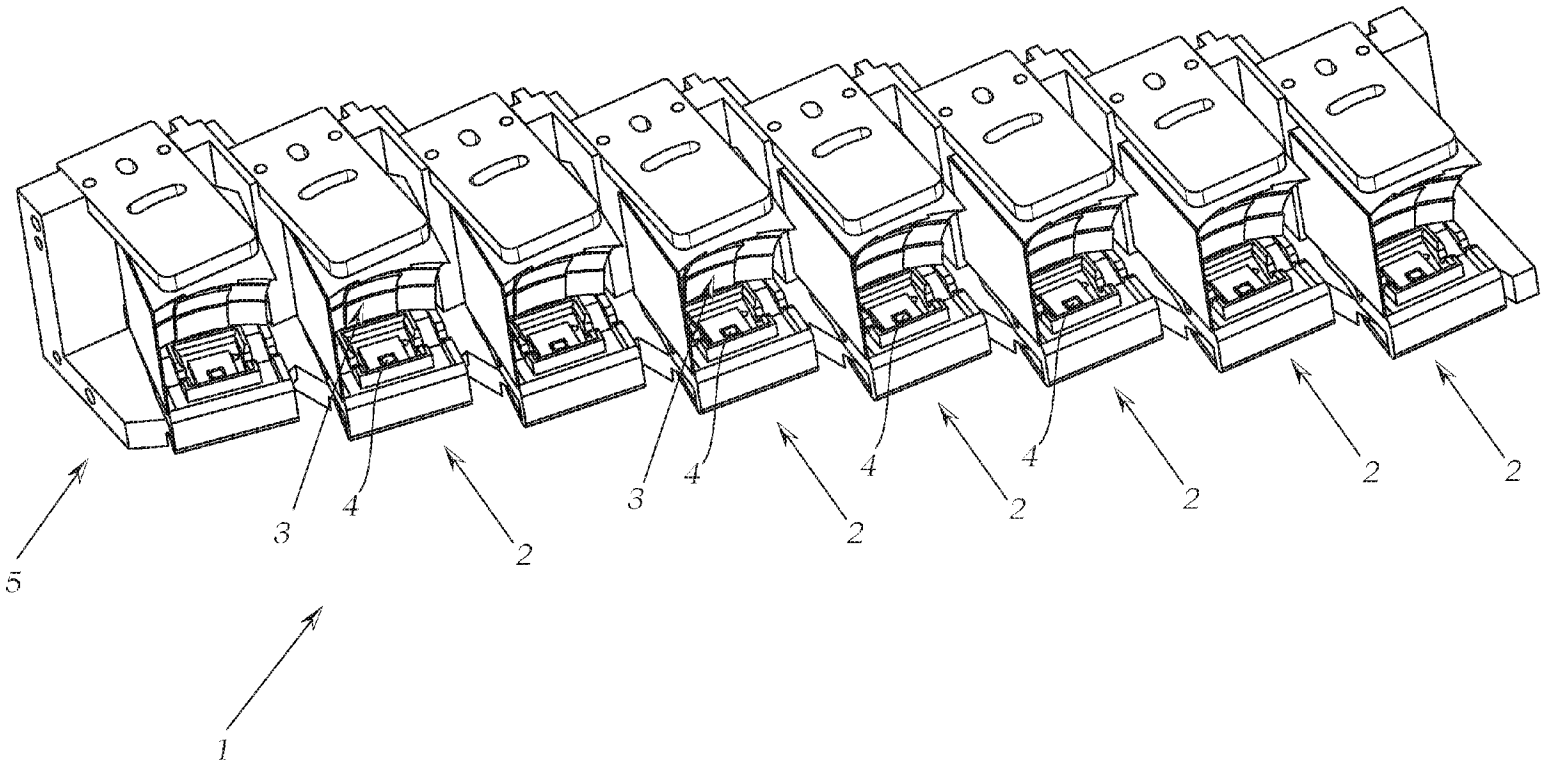

a reflector (3) and also at least one light source (4) paired with the reflector (3), wherein light from the at least one light source (4) is emitted into a region in front of the vehicle via the corresponding reflector (3) (in the installed state of the lighting device (1)), and the one or more light sources (4) is/are arranged, preferably fixedly, on at least one mounting body (5), preferably on a common mounting body (5). In accordance with the invention the reflector (3) of the at least one light unit (2), or at least one reflector (3) in the case of two or more light units (2), preferably two or more reflectors (3) of two or more light units (2), in particular preferably all reflectors (3), is/are mounted on the at least mounting body (5) so as to be pivotable about at least one axis paired with the respective reflector (3), for example a vertical axis (Z), and can be fixed in a pivoted position.

23 Claims, 12 Drawing Sheets

(52) U.S. Cl.
CPC ..... *F21S48/1305* (2013.01); *F21S 48/1742* (2013.01); *F21S 48/1752* (2013.01); *F21S 48/321* (2013.01); *F21S 48/328* (2013.01); *F21V 14/04* (2013.01); *F21S 48/137* (2013.01); *F21S 48/1747* (2013.01); *F21Y 2101/02* (2013.01)

(56) References Cited

U.S. PATENT DOCUMENTS

| | | | | |
|---|---|---|---|---|
| 8,459,850 | B2 * | 6/2013 | Herberholt | B60Q 1/2615 362/542 |
| 2005/0018437 | A1 * | 1/2005 | Hori | B60Q 1/12 362/465 |
| 2008/0089085 | A1 | 4/2008 | Popelek | |
| 2009/0296390 | A1 * | 12/2009 | Dubord | B60Q 1/24 362/240 |
| 2013/0051058 | A1 * | 2/2013 | Bako | B60Q 1/068 362/523 |

FOREIGN PATENT DOCUMENTS

| | | | |
|---|---|---|---|
| EP | 2339228 | A2 | 6/2011 |
| FR | 2797678 | A1 | 2/2001 |
| JP | 2006179246 | A | 7/2006 |
| JP | 2007005182 | A | 1/2007 |
| JP | 2008010265 | A | 1/2008 |
| JP | 2009259654 | A | 11/2009 |
| WO | 2012048351 | A1 | 4/2012 |

OTHER PUBLICATIONS

First Office Action dated Apr. 26, 2013 of the corresponding Austrian priority application No. A 50278/2012.

International Search Report dated Sep. 24, 2013 of PCT/AT2013/050129.

* cited by examiner

LIGHTING DEVICE FOR A MOTOR VEHICLE

The invention relates to a lighting device for a motor vehicle, comprising at least one light unit, for example two or more light units, wherein each light unit comprises:

a reflector and also at least one light source paired with the reflector, wherein light from the at least one light source is emitted into a region in front of the vehicle via the corresponding reflector (in the installed state of the lighting device), and the one or more light sources is/are arranged, preferably fixedly, on at least one mounting body, preferably on a common mounting body.

The invention also relates to a headlight for a motor vehicle, comprising at least one such lighting device.

Lastly, the invention also relates to a headlight system having a left and a right headlight for producing an overall light distribution.

Such lighting devices, for example for producing a segmented light distribution, are known. Each of the light units of the lighting device produces one or more light segments (sub-light distributions) of the light distribution, segments in the light distribution can be masked out, i.e. not illuminated, by selectively switching on and off individual light units, or one or more segments can be illuminated selectively. By way of example, the segmented light distribution is a main beam distribution (here, the total main beam distribution is formed by two lighting devices, which are installed in a left and a right vehicle headlight), which is constructed from light segments arranged adjacently to one another horizontally.

In order to be able to produce a legally compliant or an optimal overall light exposure, it is important that the sub-light distributions, which are produced with the individual light units, can be oriented relative to one another optimally, in particular in a horizontal and/or vertical direction.

The object of the invention is to enable such an orientation of the sub-light distributions in a simple and reliable manner.

This object is achieved with a lighting device as mentioned in the introduction in that, in accordance with the invention, the reflector of the at least one light unit, or at least one reflector in the case of two or more light units, preferably two or more reflectors of two or more light units, in particular preferably all reflectors, is/are mounted on the at least mounting body so as to be pivotable about at least one axis paired with the respective reflector, for example a vertical axis, and can be fixed in a pivoted position.

As a result of the invention it is possible, in the case of a lighting device as mentioned in the introduction, to optimally align with one another the light exposure of the one or more light units by appropriately adjusting one or more, preferably all, reflectors, such that a desired, optimal and legally compliant overall light exposure is produced.

Here, a reflector holder is preferably provided for each pivotable reflector, which reflector holder(s) is/are mounted so as to be pivotable with respect to the mounting body about the at least one axis, for example about the vertical axis.

Here, in a variant, the pivotable reflector is fixedly connected to the reflector holder or is preferably formed in one piece with the reflector holder.

The reflector and reflector holder are thus one part, on which the reflecting face of the reflector is formed. In this embodiment, the reflector and reflector holder are thus terms that are synonymous for one another. In this embodiment the reflector has a simple, compact and stable design formed from few component parts.

However, the pivotable reflector may also be formed as a component part formed separately from the reflector holder, which component part is mounted movably on the reflector holder.

In this case, the reflecting face is thus formed on the component part (also referred to as a reflector block), and the component part is mounted movably on the reflector holder. The advantage of this variant lies in the fact that, besides the pivotability of the reflector holder (and thus of the reflector), the reflector can also be displaced with respect to the reflector holder, such that a number of adjustment possibilities are provided.

Independently of whether the reflector is formed separately from the reflector holder or is connected thereto fixedly/connected thereto in one piece, the reflector holder can be easily fixed in a pivoted position on the mounting body using fixing means, for example using at least one screw.

In a variant in which the reflector is formed as a component part formed separately from the reflector holder, this component part advantageously can be fixed on the reflector holder using fixing means, for example using at least one screw.

In accordance with a specific embodiment, the reflector holder is mounted so as to be pivotable about the vertical axis via a first bearing point and a second bearing point, which are arranged on the mounting body.

Here, the terminology "bearing point . . . arranged" includes the fact that this bearing point can be directly attached to the mounting body, but does not necessarily have to be directly attached to the mounting body. The bearing point can thus be connected directly and fixedly to the mounting body, or can be attached to a mounting plate (see further below), which mounting plate itself is in turn fixedly connectable or connected to the mounting body.

Preferably, in order to allow a pivoting about a vertical axis, the two bearing points are arranged opposite one another, for example (in the installed state) in an upper and a lower region of the mounting body.

In accordance with an advantageous embodiment of the invention, the mounting body has a horizontal light source mounting portion for mounting the light sources, a vertical portion extending vertically away from the horizontal light source mounting portion, and at least one further bearing point portion, which extends approximately parallel to the light source mounting portion and on which the at least one bearing point for the at least one reflector holder is arranged, wherein the second bearing point is arranged on the light source mounting portion.

Here, in particular, a bearing point portion is provided for each reflector holder, wherein each bearing point portion has a bearing point for a reflector holder.

It is particularly advantageous if a bearing point portion is formed as a mounting plate which is separate from the mounting body and which can be fixedly connected to the mounting body in a region facing away from the light source mounting portion of the mounting body.

This has the advantage that the bearing point portions do not have to be formed on the mounting body and said mounting body therefore can be manufactured more easily.

In addition, the use of a dedicated mounting plate has the advantage that this mounting plate itself and therefore the bearing point can be displaced on the plate to a certain extent and thus can be positioned appropriately.

Furthermore, at least one fixing means, for example a fixing screw, is mounted rotatably in the at least one bearing point portion, by means of which fixing means the reflector holder can be fixed in a position pivoted about the vertical axis.

In this way, a reflector can be fixed in "its" bearing point portion, that is to say on "its" mounting plate, and thus can also be fixed with respect to the mounting body.

In particular, it is advantageous if the reflector is formed as a component part separate from the reflector holder and if the component part separate from the reflector holder is mounted in the reflector holder so as to be displaceable in the vertical direction.

Alternatively or additionally, the component part separate from the reflector holder advantageously also can be mounted on the reflector holder so as to be pivotable with respect thereto about an axis, preferably about the vertical axis.

For fixing, at least one fixing means, for example a fixing screw, is provided, by means of which fixing means the component part can be fixed on the reflector holder, preferably in a vertical portion of the reflector holder containing the slot.

It is also advantageous if a bearing point for the reflector holder is formed as a cylinder extension and if the reflector holder has a corresponding cylindrical opening, preferably a part-cylinder opening, by means of which the reflector holder is mounted rotatably on the cylinder extension.

In particular, it is advantageous here if the cylinder extension is arranged on the light source mounting portion of the mounting body.

Here, the cylinder extension may be arranged on an inner face of the light source mounting portion or of the bearing point portion.

The "inner" face here is the face on which the light source is arranged.

In this case, the reflector holder can be "fitted" easily via the cylinder opening thereof onto the cylinder extension during assembly.

However, the cylinder extension may also be arranged on an outer face of the light source mounting portion or of the bearing point portion, and the reflector holder may engage around the light source mounting portion via the cylinder opening.

Functionally, it makes no difference here whether the cylinder extension sits externally or internally, however internally sitting variants may lead to space problems due to the circuit board for the light sources, and therefore the externally arranged cylinder extension is then preferred.

It is then also expedient if a bearing point is formed as a part-sphere receptacle/part-sphere on the mounting body, in particular on the light source mounting portion, or preferably is formed on the bearing point portion, and a part-sphere/part-sphere receptacle for the first-mentioned part-sphere receptacle/part-sphere is formed on the reflector holder.

The part-sphere receptacle/part-sphere is then advantageously arranged on an inner face of the light source mounting portion or of the bearing point portion.

In accordance with a further variant of the lighting device according to the invention, the at least one reflector is formed in one piece with the corresponding reflector holder thereof, wherein the reflector holder is mounted on a carrier element so as to be pivotable with respect to the mounting body about at least one axis, for example a vertical axis, and wherein the carrier element has a two-part design, and +) comprises an L-shaped mounting bracket, which mounting bracket can be attached on a light source mounting portion of the mounting body and is connectable to a second vertical portion of the mounting body extending away from the horizontal light source mounting portion substantially vertically.

+) comprises an L-shaped mounting bracket, which can be fastened to a substantially vertical portion of the mounting bracket, and which mounting bracket has a substantially horizontal retaining bracket portion, on which the reflector is mounted pivotably about the vertical axis and can be fixed in a pivoted position by means of a fixing means.

It is advantageous in this respect if the retaining bracket can be displaced in the vertical direction with respect to the mounting bracket and can be fixed in a position using a fixing means.

It is advantageous if the mounting bracket can be attached to the light source mounting portion of the mounting body so as to be pivotable about a horizontal axis arranged transversely to the light exit direction.

The reflector is thus pivotable about the z-axis, that is to say the vertical axis. The reflector furthermore is also displaceable in the z-direction, i.e. the reflector can also be adjusted (displaced) vertically. Lastly, the reflector may also be pivoted about a horizontal axis (y-axis) for a precise adjustment.

The fixing means in the form of a screw is thus used for fixing and for adjusting. Due to the adjustment, it may therefore be that the lower face of the retaining bracket does not rest flat on the circuit board, but has a slight angle of inclination.

In accordance with a specific embodiment of the invention, the light sources of the light units each comprise at least one light-emitting diode, preferably at least two or more light-emitting diodes.

From a visual viewpoint, it may be advantageous if the vertical pivot axis of a reflector runs through the mid-point or the centre of the light source.

The mounting body is preferably formed as a heat sink for the light sources in order to dissipate the waste heat of the light sources.

The invention also relates to a headlight for a motor vehicle, comprising at least one above-described lighting device.

In addition, the invention relates to a headlight system having a left and a right headlight for producing an overall light distribution, wherein the left headlight preferably produces the left part of the overall light distribution and the right headlight preferably produces the right part of the overall light distribution.

The left and the right part of the overall light distribution may advantageously overlap in the middle, as viewed in the horizontal direction.

Figure 1A:
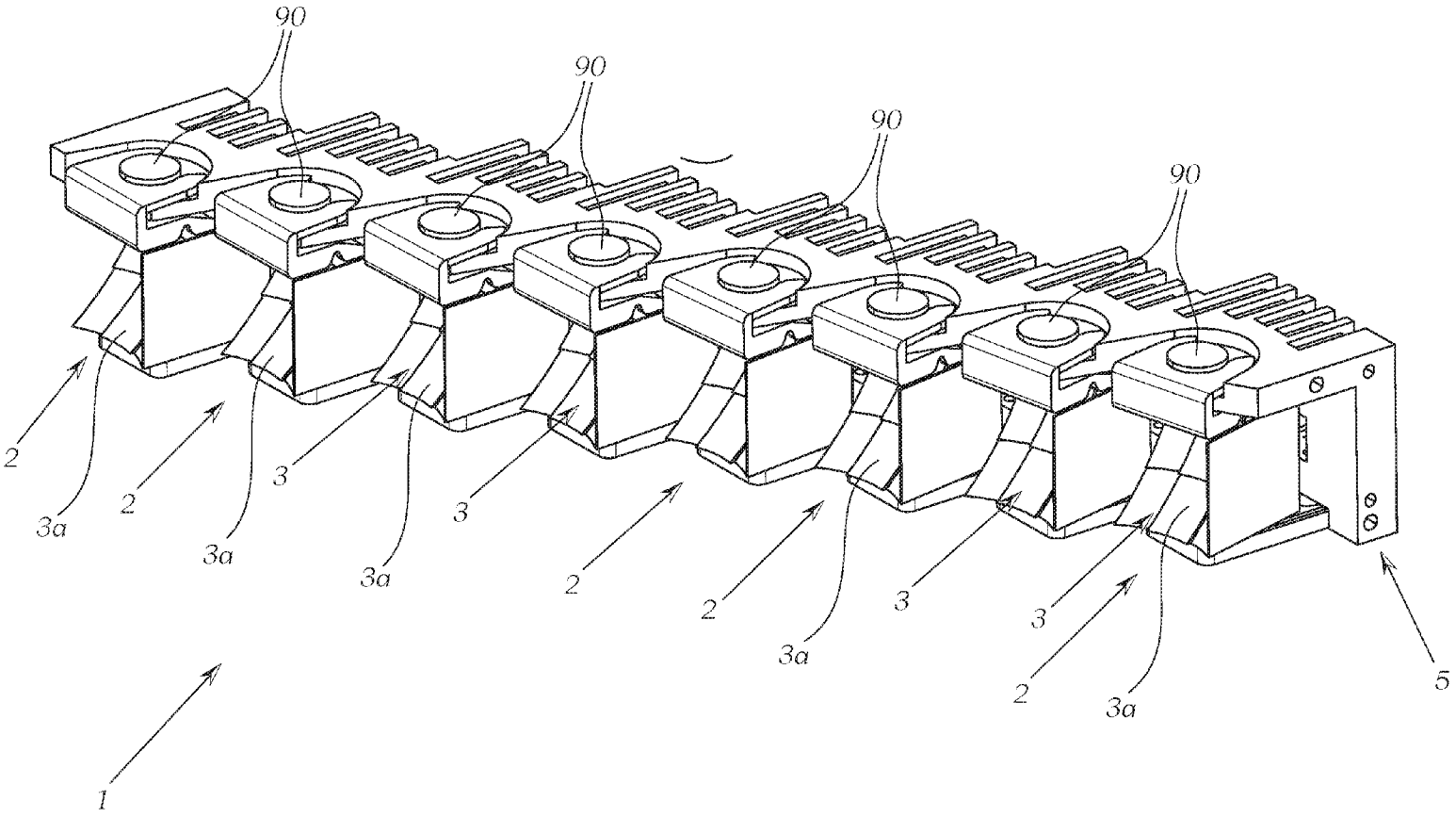
Figure 2:
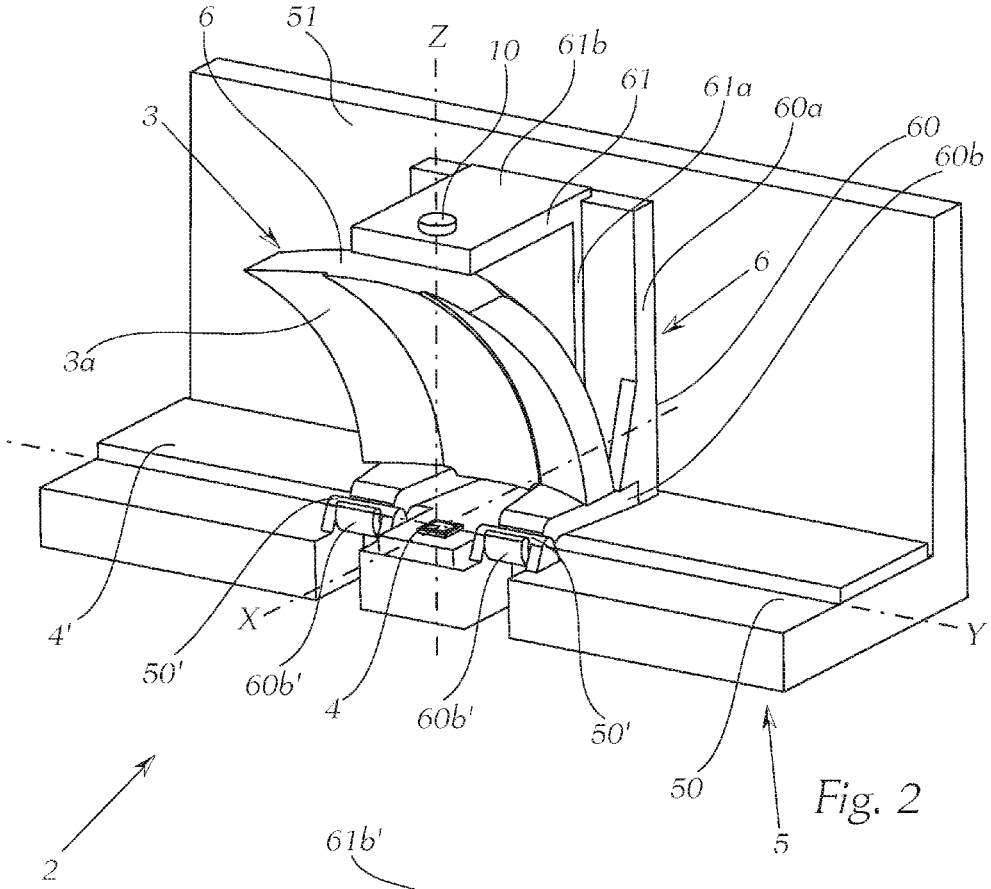
Figure 2A:
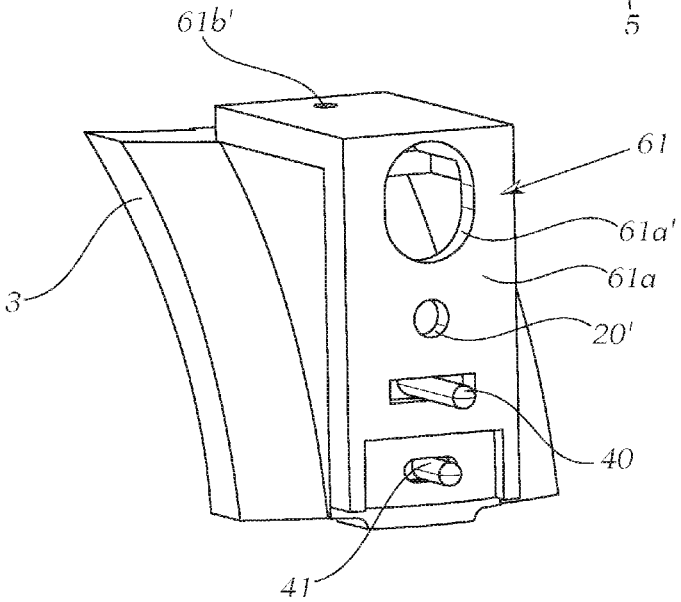
Figure 2B:
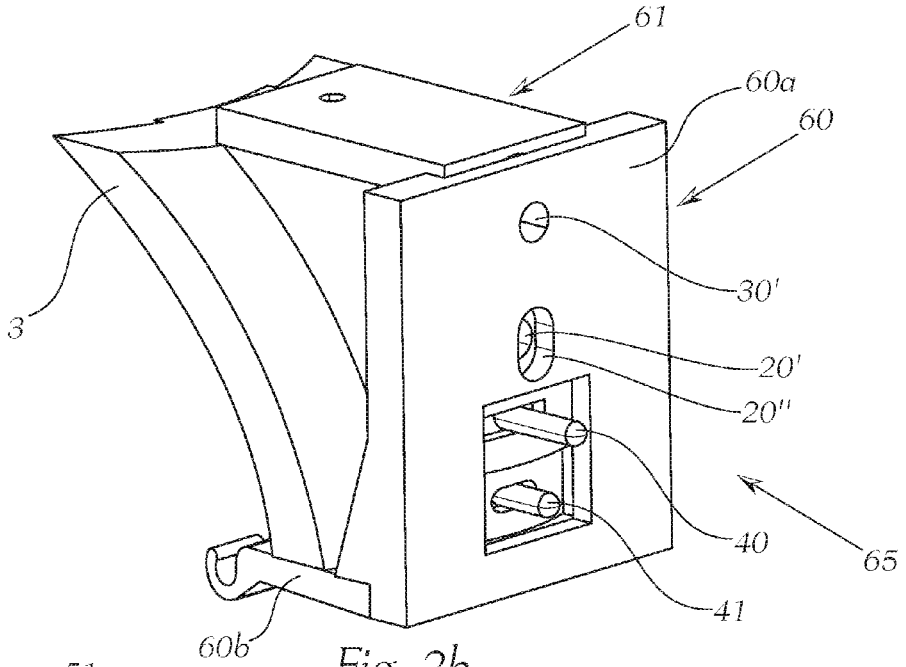
Figure 2C:
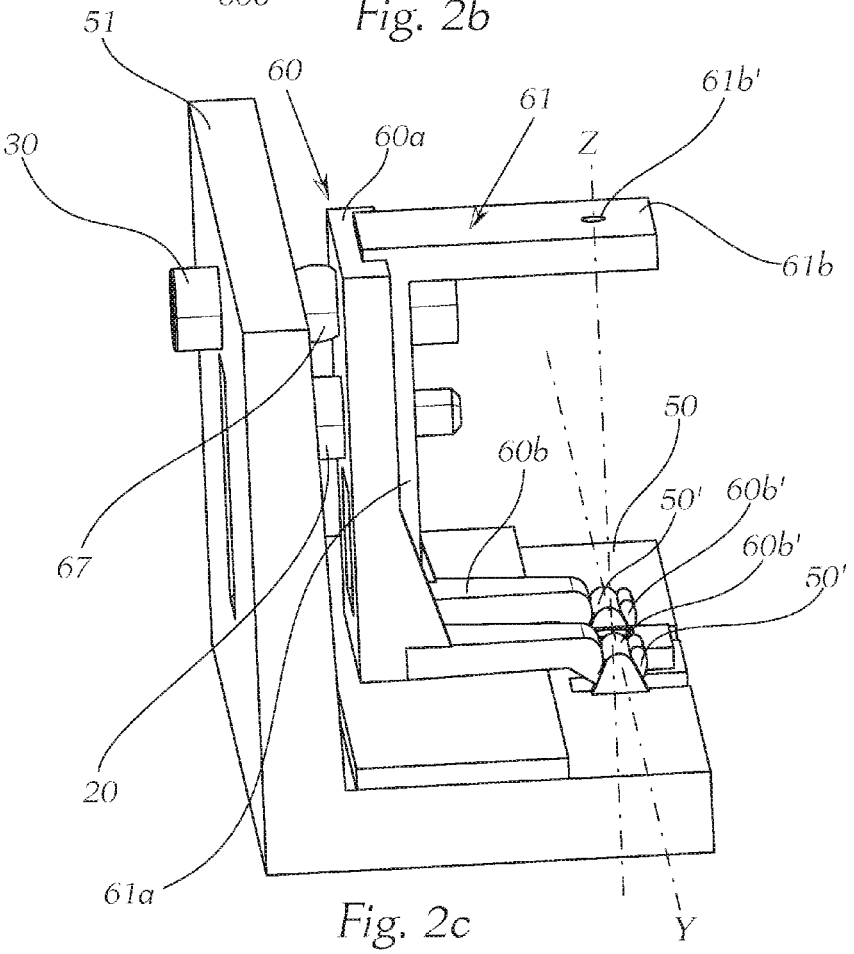
Figure 3:
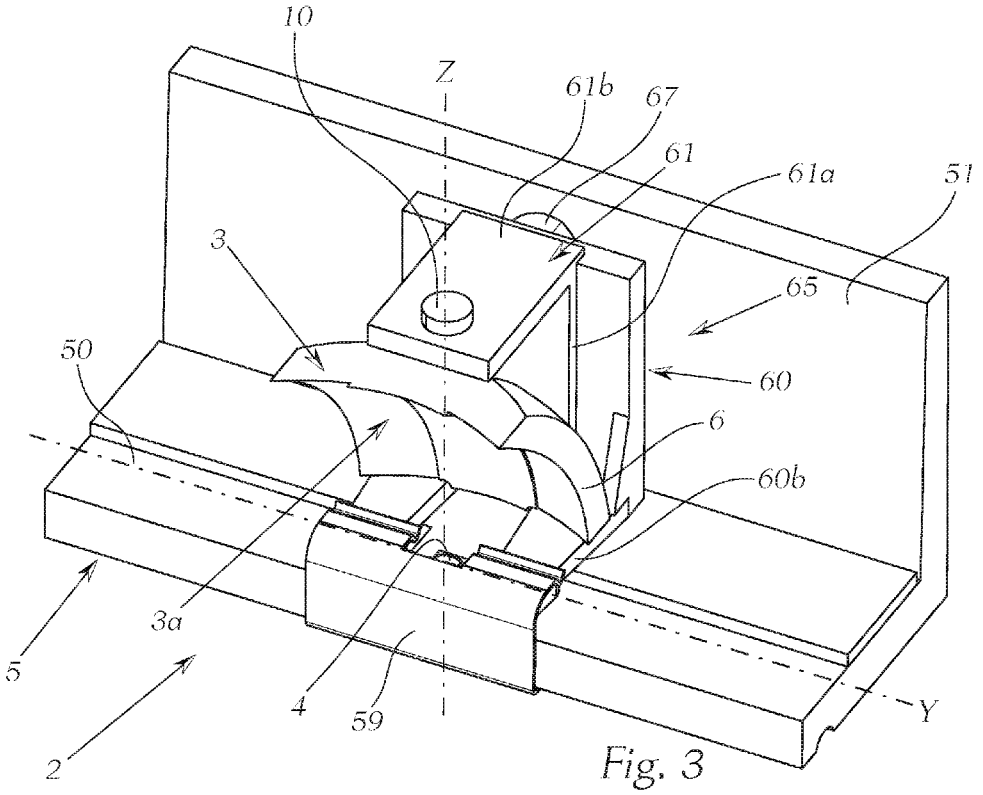
Figure 3A:
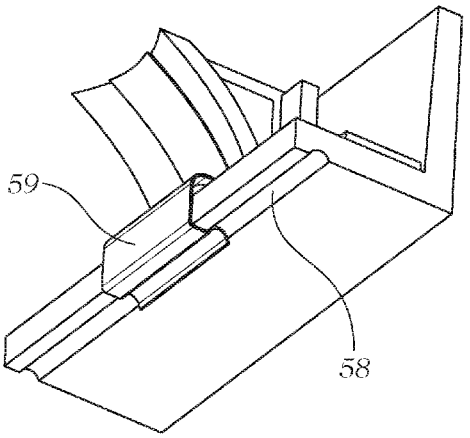
Figure 3B:
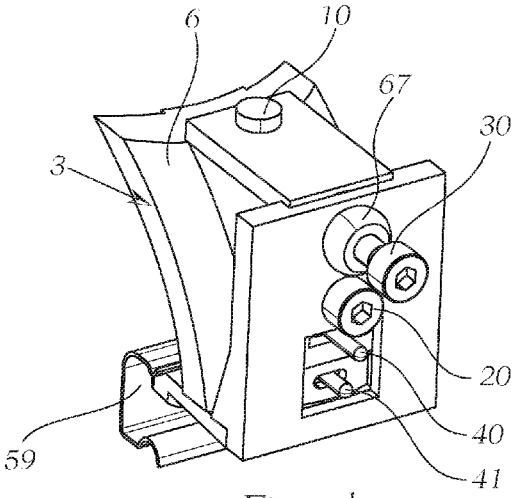
Figure 3C:
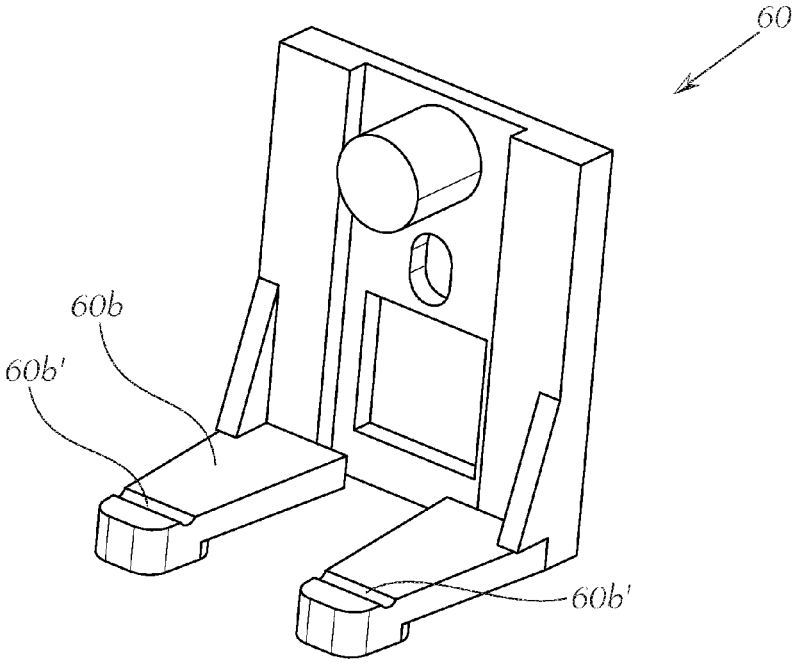
Figure 3D:
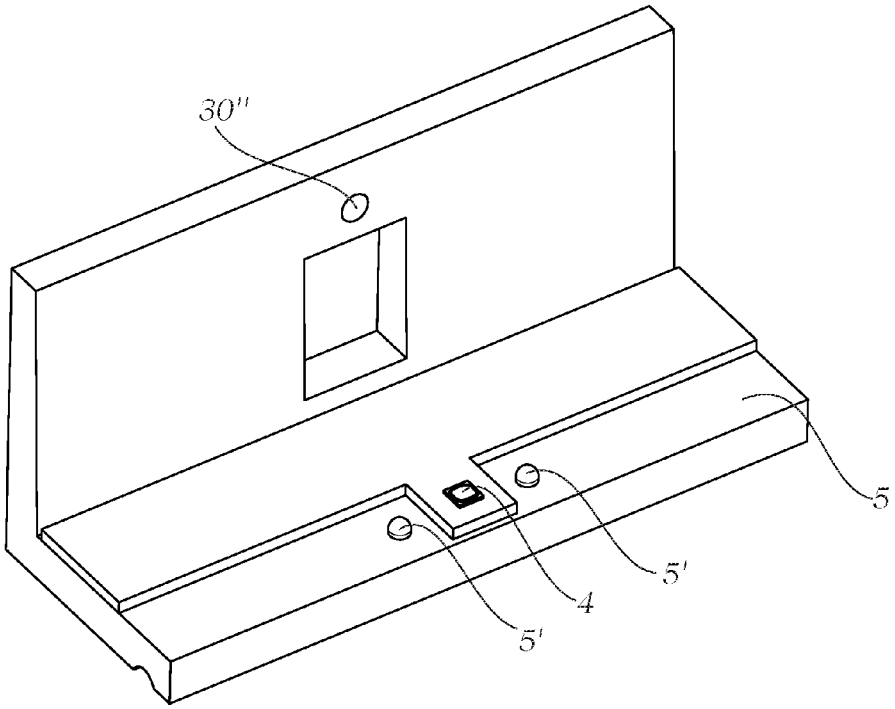
Figure 4:
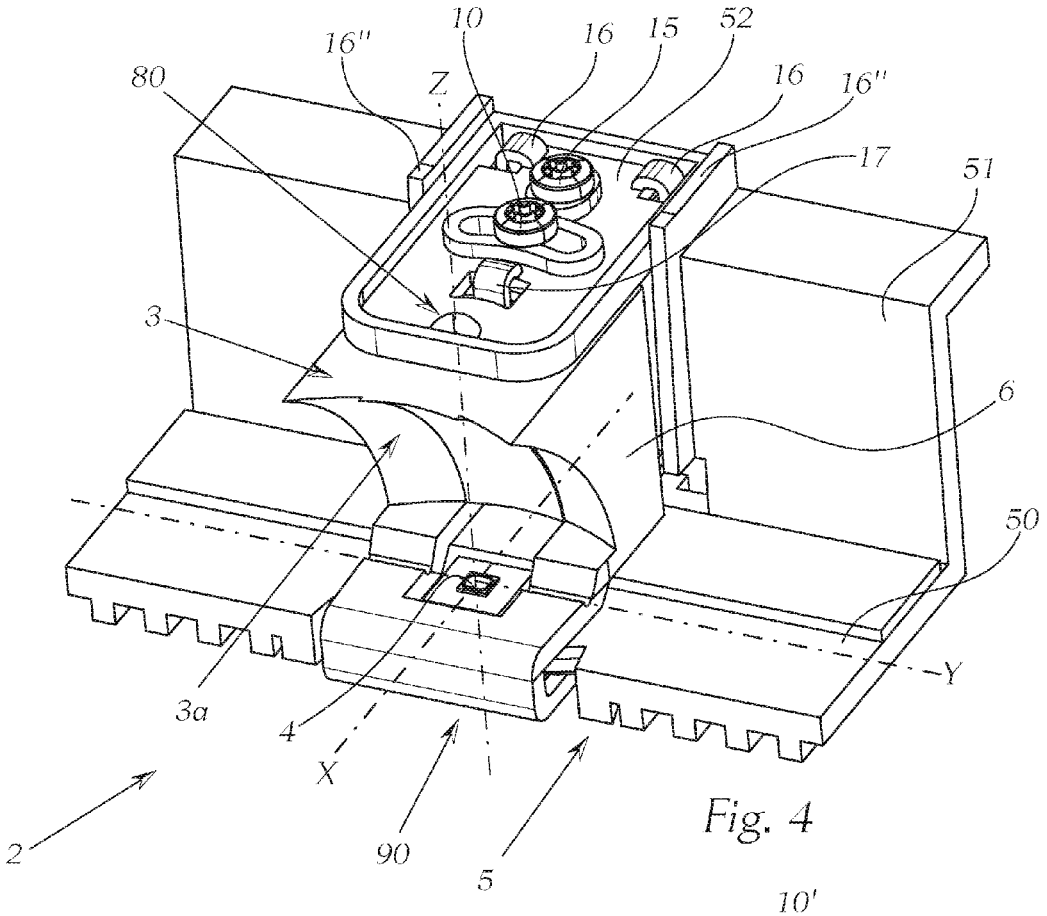
Figure 4A:
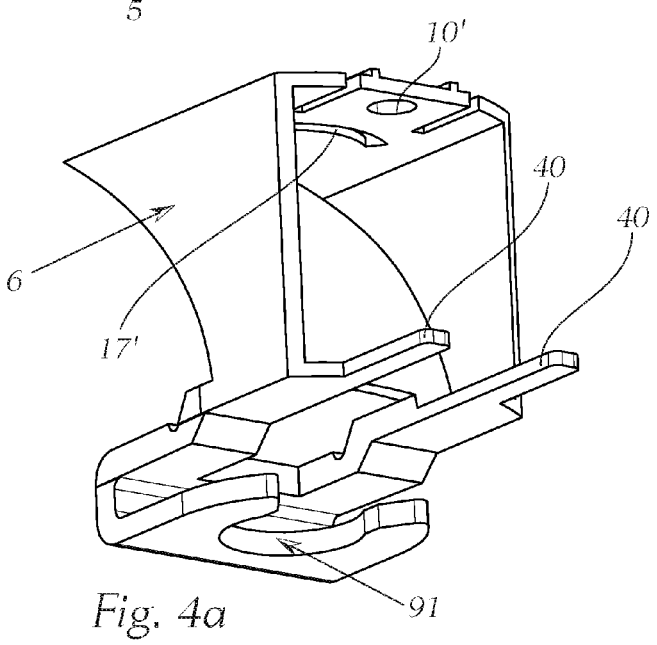

The invention is explained in greater detail hereinafter on the basis of the drawing, in which FIG. 1 shows a perspective view of a lighting device according to the invention obliquely from above, FIG. 1*a* shows the lighting device from FIG. 1 in a perspective view obliquely from below, FIG. 2 shows a detailed view of a light unit for a lighting device according to the invention in a first variant, FIG. 2*a* shows a perspective view of a reflector and part of a carrier element of a light unit from FIG. 2 in a perspective view obliquely from behind, FIG. 2*b* shows a perspective view as in FIG. 2*a* with a complete carrier element, FIG. 2*c* shows the component parts from FIG. 2*b*, with omission of the reflector, positioned on a mounting body, FIG. 3 shows a detailed view of a light unit for a lighting device according to the invention in a second variant in a perspective view obliquely from the front, FIG. 3*a* shows the detail of the lighting device illustrated in FIG. 3 in a view obliquely from below, FIG. 3*b* shows a perspective view of a reflector holder and reflector of the light unit from FIG. 3 in a perspective view obliquely from behind, FIG. 3*c* shows a perspective view of part of a carrier element for the reflector, FIG. 3*d* shows the mounting body in the bearing region of the carrier element for the reflector, FIG. 4 shows a detailed view of a light unit for a lighting device according to the invention in a third variant in a perspective view from the front, FIG. 4*a* shows a reflector for the lighting device from FIG. 4 in a perspective view from below.

Figure 5:
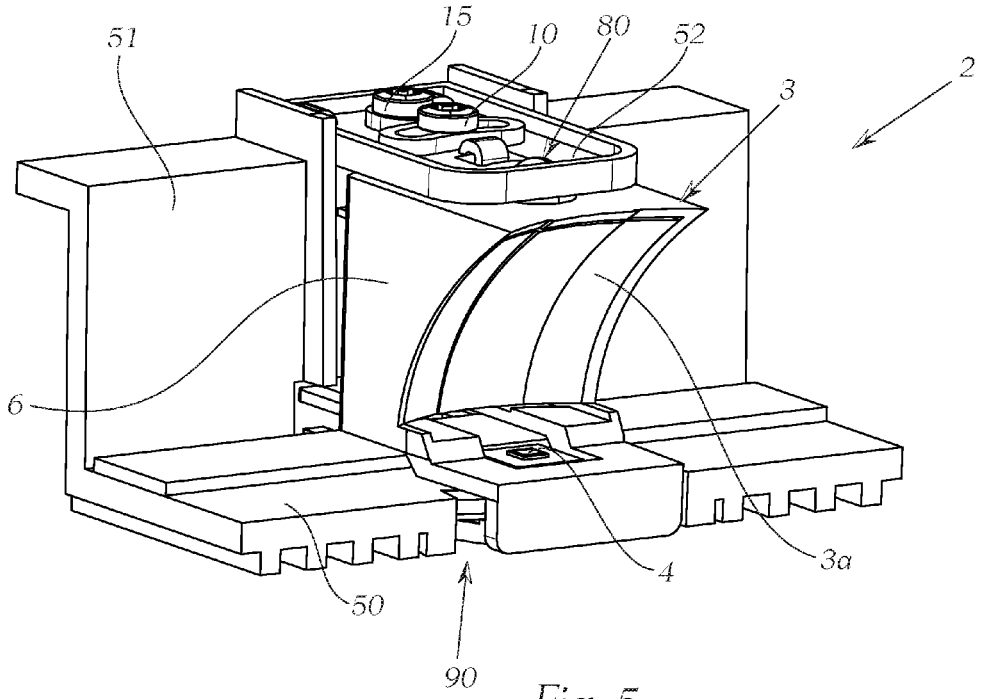
Figure 5A:
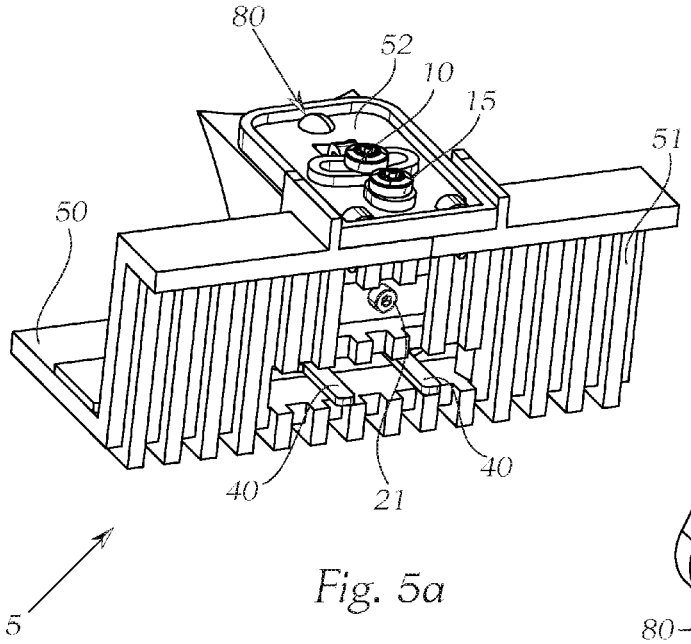
Figure 5B:
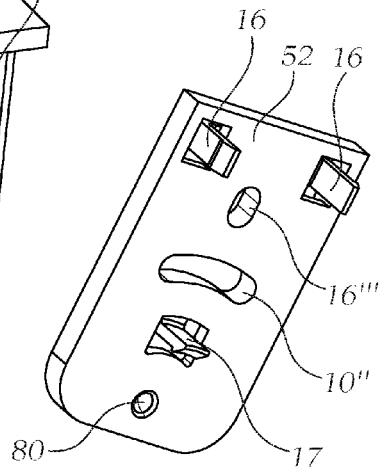
Figure 5C:
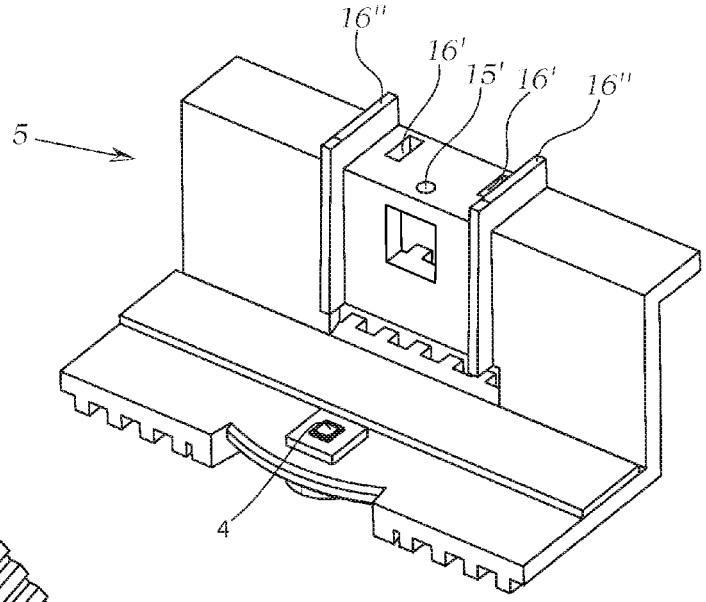
Figure 5D:
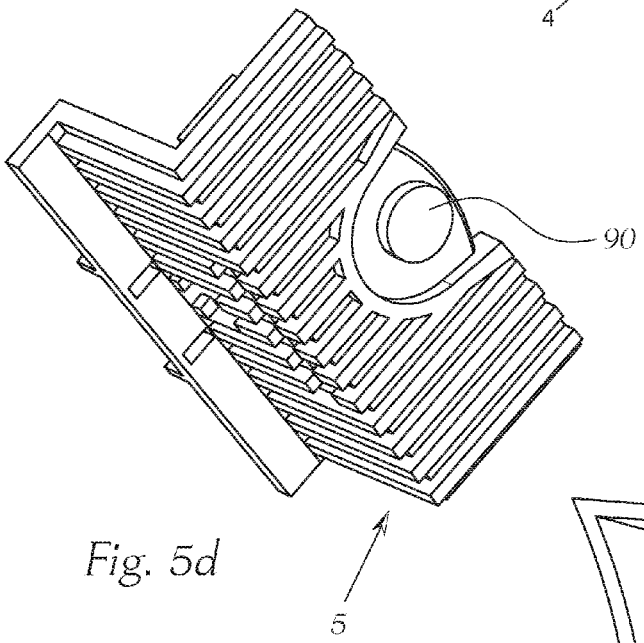
Figure 5E:
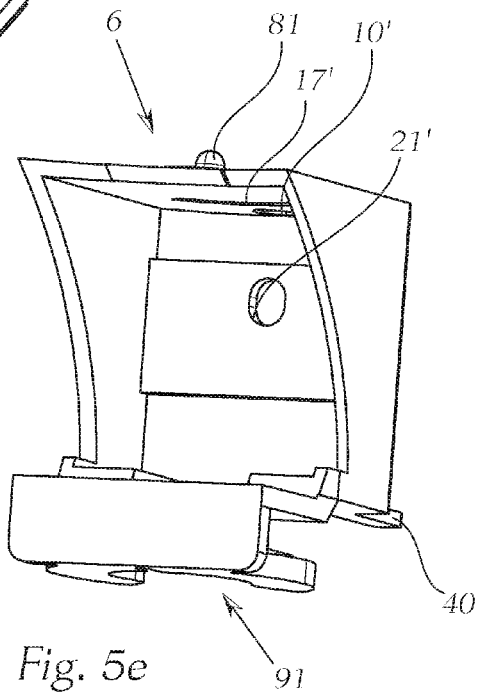
Figure 5F:
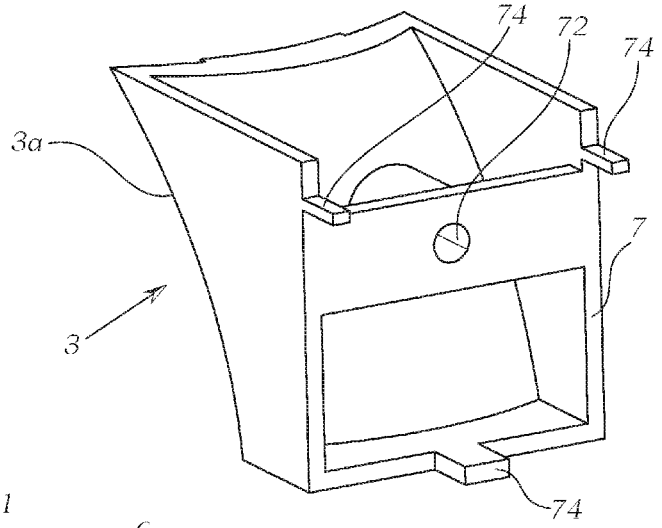
Figure 5G:
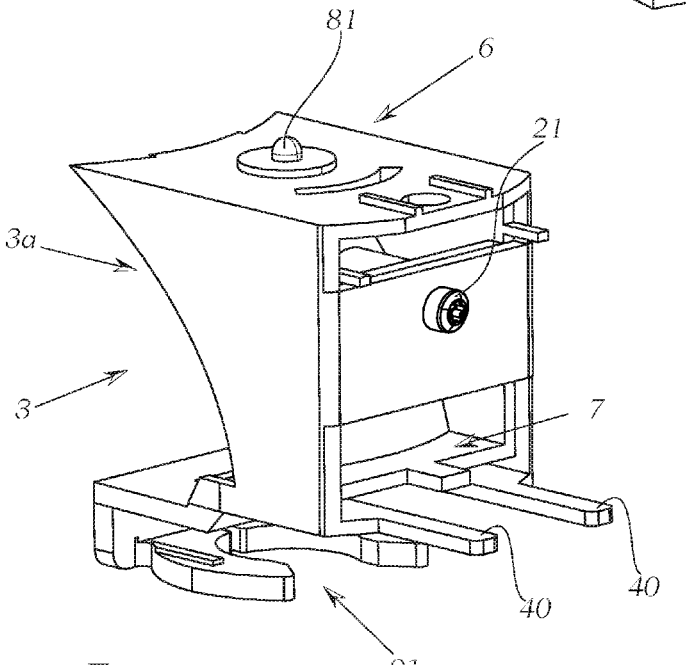
Figure 6:
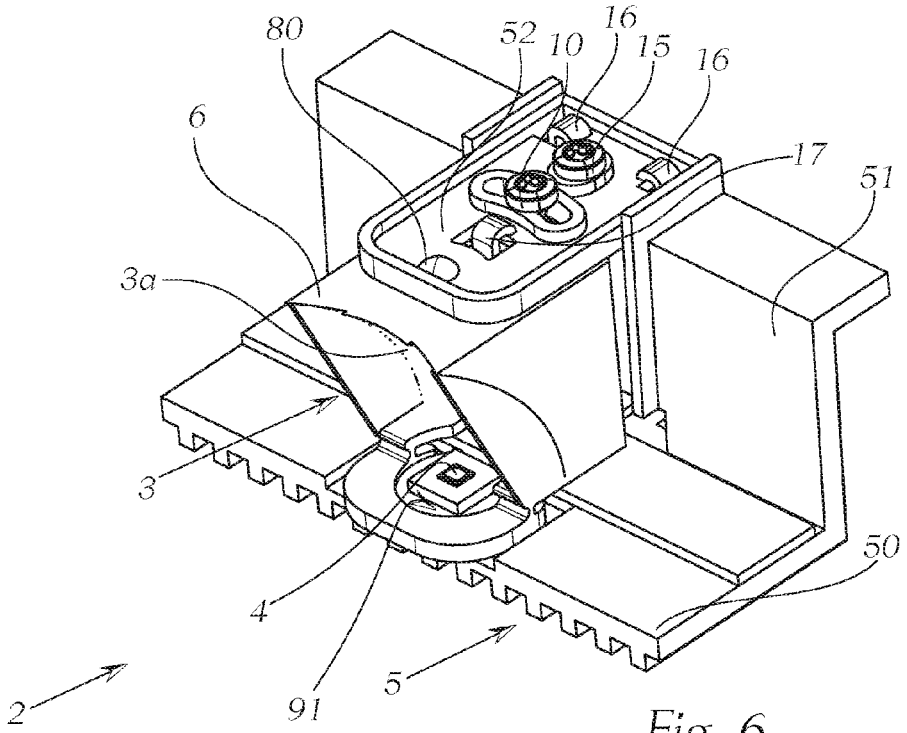
Figure 6A:
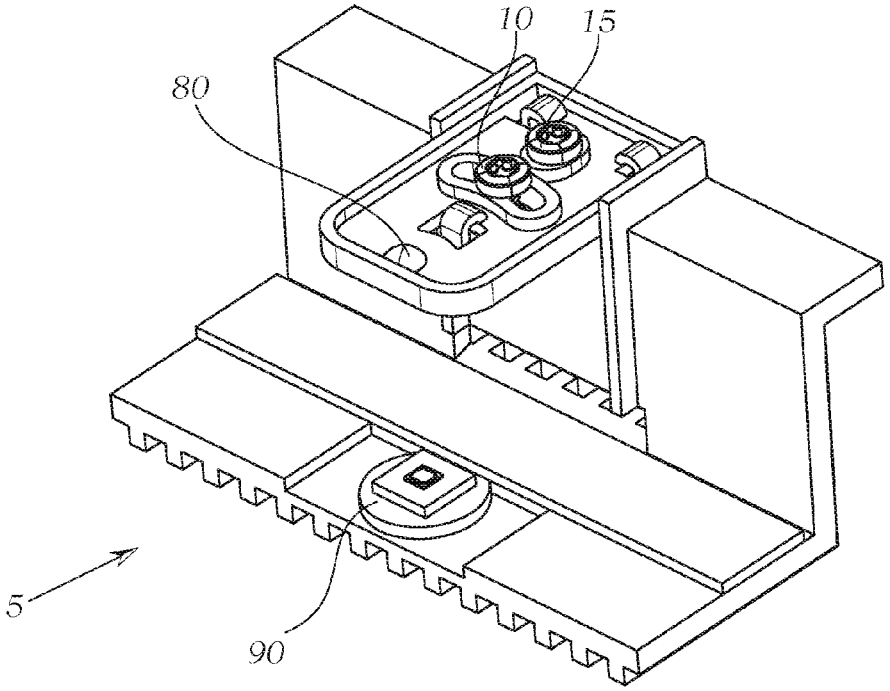
Figure 6B:
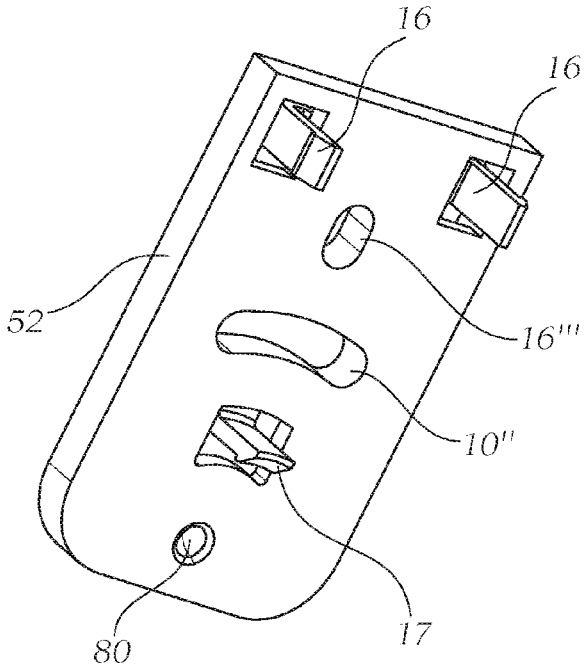
Figure 6C:
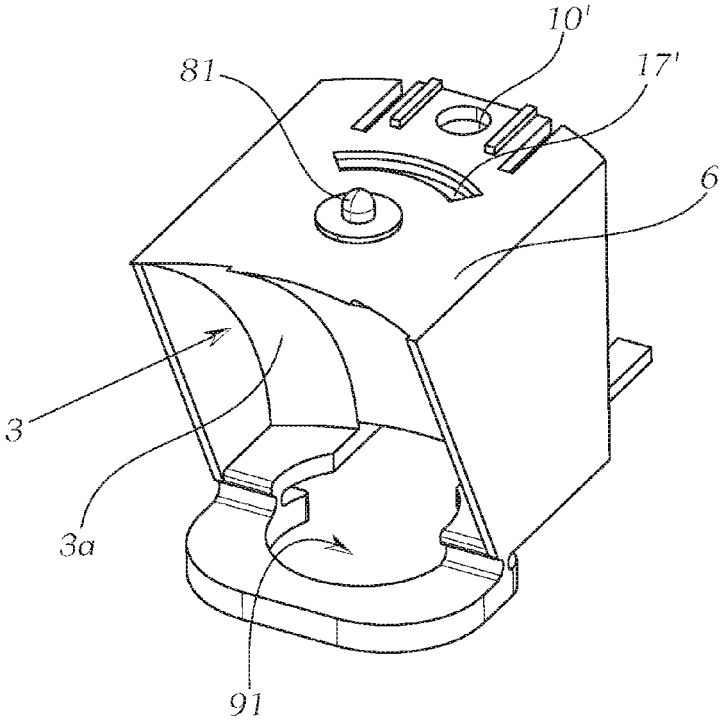

FIG. 5 shows a detailed view of a light unit for a lighting device according to the invention in a fourth variant in a perspective view from the front, FIG. 5*a* shows the lighting device from FIG. 5 in a view obliquely from behind, FIG. 5*b* shows a mounting plate from FIG. 5 in a view obliquely from below, FIG. 5*c* shows the mounting body for the lighting device from FIG. 5 in a perspective view obliquely from the front with attached light source, FIG. 5*d* shows the mounting body from FIG. 5*d* in a perspective view obliquely from below, FIG. 5*e* shows the reflector holder from FIG. 5 in a perspective view obliquely from the front, FIG. 5*f* shows the reflector from FIG. 5 in a perspective view obliquely from behind, FIG. 5*g* shows the reflector from FIG. 5*f* inserted into a reflector holder from FIG. 5*e*, FIG. 6 shows a detailed view of a light unit for a lighting device according to the invention in a fifth variant in a perspective view from the front, FIG. 6*a* shows the mounting body from FIG. 6 with mounted mounting plate and light source, FIG. 6*b* shows the mounting plate from FIGS. 6 and 6*a* in a perspective view obliquely from below, and FIG. 6*c* shows the reflector or reflector holder used in FIG. 6 with reflector formed in one piece in a perspective view obliquely from the front.

FIGS. 1 and 1*a* show a lighting device 1 for a motor vehicle from different perspectives, said lighting device comprising eight light units 2 in the shown example.

Here, the view in FIG. 1 is defined as a view from "above", and the references "above" and "below in the following figures" are selected accordingly. In fact, however, depending on the embodiment of the light units, in particular of the reflectors, the lighting device can be arranged both in the position as illustrated in FIG. 1 and also upside down, and therefore the "underside" visible in FIG. 1*a* in the present terminology would then form the upper side.

Here, the figures show a left lighting device, and together with a right lighting device this headlight arrangement produces an overall light distribution for a motor vehicle.

Each light unit 2 comprises a reflector 3 and also a light source 4 paired with the reflector 3, such that light from the light source is emitted into a region in front of the vehicle via the corresponding reflector 3 (in the installed state of the lighting device 1).

The reflecting faces 3*a* of the reflectors 3 can be smooth by way of example, or for example can be formed in a segmented manner.

The light sources 4 of the light units 2 each comprise at least one light-emitting diode, preferably two or more light-emitting diodes, and these lie in a horizontal plane and illuminate the corresponding reflectors 3, which radiate light into the space outside the headlight or into a region in front of the lighting device.

Each light unit 2 forms a sub-light distribution, and the sub-light distributions of the eight light units 2 form a (overall) light distribution of the lighting device 1.

The sub-light distributions of the individual light units 2 by way of example are arranged here adjacently to one another in the horizontal direction, and the reflectors 3 of the light units 2 are designed in such a way that the sub-light distributions of the light units 2 each have at least one sharply projected vertical light-dark boundary, possibly two sharply projected vertical light-dark boundaries, laterally delimiting the respective sub-light distribution.

Here, "vertical" means that the LD boundary runs vertically with projection onto a vertical shield positioned in front of the lighting device, for example at a distance of 25 or 10 meters. Of course, this LD boundary lies in a generally horizontal plane in the light exposure on the carriageway. This is clearly evident to a person skilled in the art and is to serve here merely for clarification.

The light sources 4 of the individual light units 3 can be actuated independently of one another. In this way, the individual light units can be switched on and switched off independently of one another, and can possibly also be dimmed, such that the individual sub-light distributions of the light units can be switched on and switched off individually.

Furthermore, it may also be advantageous if, in the case that two or more light-emitting diodes are provided for a light source, the light-emitting diodes of a light source can also be actuated independently of one another, or the light-emitting diodes of a light source are combined in groups and the individual groups can be actuated independently of one another.

By way of example, a light source may have one or more LED chips, each with one or more light-emitting diodes. The chips can be actuated or connected separately.

Each light unit thus produces one or more segments in the light exposure (depending on the number of independently actuatable chips), and these individual segments of a light unit can then also accordingly be controlled independently of the other segments.

In order to be able to orientate the sub-light distributions optimally relative to one another, the present invention presents a plurality of embodiments linked by a common inventive concept, these embodiments being explained below.

In principle, it is true for all embodiments that, as already mentioned above, the light sources 4 of the individual light units 3 are attached on a common mounting body 5. This mounting body 5 is preferably formed as a heat sink, that is to say for example from a material that is an effective heat conductor, preferably a metal, and preferably has cooling fins so as to be able to dissipate the waste heat of the light sources.

However, a plurality of separate mounting bodies could also be provided, and one or more light sources could be located on each of the individual mounting bodies. The individual mounting bodies are positioned fixedly relative to one another. The reflectors paired with the light sources are then attached to the mounting body of the corresponding light source so as to each be pivotable with respect to said mounting body.

Variant 1

With this embodiment illustrated in FIGS. 2 and 2*a*-2*c*, the mounting body 5 has an L-shaped profile, as can be clearly seen in FIG. 2.

The reflector 3, which has a reflecting face 3*a*, is formed in one piece with a reflector holder, and the reflector holder 6 is mounted on a carrier element 65 so as to be pivotable about a vertical axis Z.

The carrier element 65 has a two-part design and consists of an L-shaped mounting bracket 60 and an L-shaped retaining bracket 61.

The mounting bracket 60 is attached on a light source mounting portion 50 of the mounting body 5. The light sources 4, specifically a circuit board 4', on which the light sources 4 (of all light units) are arranged, are also attached on this light source mounting portion 50.

To this end, the mounting bracket 60 has a mounting bracket portion 60*b*, which runs approximately parallel to the portion 50, is preferably flat, and via which the mounting bracket 60 can be connected to the portion 50 of the mounting body 5.

Furthermore, the mounting bracket 60 has a flat, vertically standing portion 60*a* arranged substantially normal on the mounting bracket portion 60*b*. This substantially vertically standing portion 60*a* can be connected, in the installed position, to a vertical portion 51 of the mounting body 5, as is explained in greater detail further below.

The L-shaped retaining bracket 61 has a portion 61*a*, which can be fastened to the substantially vertical portion 60*a* of the mounting bracket 60. In addition, the retaining bracket 61 has a substantially horizontal retaining bracket portion 61*b*. The reflector 3 is mounted on this horizontal retaining bracket portion 61*b*, which is substantially plate-shaped, so as to be pivotable about the vertical axis Z, and can be fixed in a pivoted position using a fixing means 10.

The inner side, that is to say the side of the component 61*a* facing the reflector, has a shape matched to the rear side of the reflector, for example an oval shape, so that the reflector can pivot about the z-axis. This is not illustrated in the figures.

The fixing means, for example a screw 10, is passed here through a bore 61*b*' through the portion 61*b* and is screwed to the reflector 3. To this end, the reflector has either a thread, or self-tapping screws are preferably used, which are screwed into the reflector 3, which to this end is preferably formed from plastic (as also in all other embodiments).

The second retaining bracket 61 is preferably displaceable in the vertical direction with respect to the first retaining bracket 60, and a position can be fixed using a fixing means 20.

In this regard, FIG. 2*a* shows the retaining bracket 61 with reflector 3 attached thereto in a view from behind. It can be seen that the portion 61*a*, in an upper region, has a slot 61*a*' and therebelow a circular hole 20'.

The circular hole 20' (without thread) is already provided here, either it is produced during the course of the injection moulding or it is drilled subsequently, and a self-tapping thread is then screwed into this hole.

A pin 40, which is moulded integrally on the reflector 3 and is used to manually adjust the reflector 3, can also be seen. The smaller pin 41 arranged therebelow is used to additionally fix the reflector 3 by means of a clamping washer. The clamping washer is fitted through the heat sink (not illustrated) onto the smaller pin 41 and is pressed with the mounting bracket 60 by means of a special tool. This additionally prevents an undesirable pivoting of the screw 10 about the z-axis.

In FIG. 2*b* the component parts from FIG. 2*a* are illustrated in a state assembled with the mounting bracket 60. The mounting bracket 60, in the vertical portion 60*a* thereof, has a bore 30' (which is produced similarly to the hole 20'), which corresponds to the slot 61*a*', and also therebelow a slot 20", which corresponds to the hole 20' in the retaining bracket 61.

By means of the fixing means 20, for example a screw, the retaining bracket 61 can be fixed to the mounting bracket 60 via the slot 20" and the opening 20', and the retaining bracket 61 can be displaced to a certain extent in the vertical direction with respect to the mounting bracket 60 through the slot 20".

Referring back to FIG. 2 and under consideration of FIG. 2*c*, it can be seen that the mounting bracket 60 is attached to the mounting body 5 at two brackets 50', which are formed on the portion 50 of the mounting body 5, by means of corresponding hooks 60*b*', which are formed on the portion 60*b* of the mounting bracket 60, so as to be pivotable about an axis Y that is horizontal in the installed position and is arranged transversely to the light exit direction.

The reflector 3 is thus pivotable about the z-axis, that is to say the vertical axis. The reflector 3 is also displaceable in the z-direction, that is to say the reflector 3 can also be adjusted (displaced) vertically. Lastly, the reflector 3 can also be pivoted about a horizontal axis (y-axis) for a precise adjustment.

To fix the mounting bracket 60 with respect to the mounting body, a fixing means 30 in the form of a screw 30 is provided. The mounting bracket 60 is pivoted about the axis Y using this fixing means, and the fixing means 30 is thus used to fix and to adjust the reflector with respect to the mounting body 5.

It may be, due to the adjustment, that the lower face of the mounting bracket 60*b* does not rest flat on the mounting body 5, that is to say does not rest on the circuit board 4', but has a slight angle of inclination (as can be deduced from the figures, the mounting bracket in principle does not lie directly on the portion 50, but on the circuit board 4, which is attached on the portion 50).

A spacer 67 is provided between the mounting bracket 60 and the mounting body 5, for example a deformable ring seal 67, which makes it possible to hold the set spacing between the holding plate and heat sink. Instead of a ring seal 67, a spiral spring could also be used.

Variant 2

The second embodiment, illustrated in FIGS. 3, 3*a* and 3*b*, is substantially identical to the first embodiment. The difference between these two embodiments lies in the fact that the mounting bracket 60 is not fixed on the upper side of the mounting body, but the mounting bracket 60 is pressed using a clip 59 against the portion 50 of the mounting body 5. The clip 59 is fixed on the underside of the portion 50 of the mounting body 5 in a groove 58, with which the further clips of the further light units (not illustrated) also engage. The clip 59 presses a front portion 60*b* of the mounting bracket 60 against the upper side of the portion 50, wherein the clip 59 and the contact region of the mounting bracket 60 to the clip 59 are formed in such a way that a pivoting of the mounting bracket 60 as described with reference to variant 1 is possible.

By way of example, the portion 60*b* here has a groove 60*b*', into which the clip 59 presses (see FIG. 3*c*), and in addition the portion 60*b*' is mounted on the mounting body 5 on two elevations 5' (FIG. 3*d*), such that the pivot motion about the axis Y is enabled.

FIG. 3*d* additionally shows a bore 30" in the mounting body, through which the screw 30 is guided.

Variants 3-5 described hereinafter largely have an identical design, which will be explained initially with reference to variant 3, and then the differences in the case of the further variants will be presented.

Variant 3

FIG. 4 again shows a portion of a mounting body 5 in the form of a heat sink in the region of a light unit 2. The mounting body has a horizontal light source mounting portion 50 for mounting of the light sources 4, and also a vertical portion 51 extending vertically away from the horizontal light source mounting portion 50.

In addition, the mounting body 5 has a further bearing point portion 52, which extends approximately parallel to the light source mounting portion 50, is preferably formed as a mounting plate 52 separate from the mounting body 5, and can be connected fixedly to the mounting body 5 in a region facing away from the light source mounting portion 50 of the mounting body 5.

This has the advantage that the bearing portions do not have to be formed on the mounting body, and the mounting body thus can be manufactured more easily.

In addition, the use of a dedicated mounting plate 52 has the advantage that this mounting plate itself and therefore the bearing point (see further below) on the plate can be displaced to a certain extent and thus can be positioned accordingly.

Hereinafter, reference is also made to the figures with regard to variants 4 and 5, since individual component parts that are used identically in variant 3 can be better seen here. The mounting plate 52 is illustrated in an isolated manner in FIGS. 5*b* and 6*b*. The mounting plate 52 has two detent lugs/hooks 16, by means of which said mounting plate can be fixed in corresponding recesses 16' in the case of mounting in the mounting body 5 (see FIG. 5*c*). The hooks 16 are used primarily only for easier handling, so that the plate 52 can be fixed temporarily already on the heat sink, before a screw is also attached. The webs 16" on the heat sink 5, between which the holding plate 52 is located, already define the position of the holding plate in the Y direction very accurately. A displacement of the holding plate 52 in the X direction, however, is also possible for the purpose of positioning.

Lastly, the plate 52 can be fixed to the heat sink 5 using a screw 15, for which purpose on the one hand the plate 52 has a slot 16'" (FIG. 5*b*) and on the other hand a threaded bore 15' (FIG. 5*c*) is provided in the heat sink 5.

Referring back to FIG. 4, it can be seen that a reflector holder 6 is also provided. In the shown variant 3, the reflector 3 and the reflector holder 6 are formed in one piece with one another. The reflector 3 and reflector holder 6 are thus one part, on which the reflecting face 3*a* of the reflector 3 is formed. In this embodiment (and also in variants 1, 2 and 5), the reflector 3 and reflector holder 6 are thus synonymous terms for one another. The reflector 3 in this embodiment has a simple, compact and stable design formed from few component parts.

The reflector holder 6 is pivotable about the Z-axis and can be fixed in a pivoted position.

To this end, a first bearing point 80 is provided on the plate 52 for the reflector holder 6, and also a second bearing point 90 is provided on the light source mounting portion 50. The two bearing points are arranged opposite one another and define the pivot axis Z.

One of the two bearing points 80, 90, specifically the second bearing point 90 for the reflector holder 6, is formed as a cylinder extension 90. This cylinder extension is indicated in FIG. 4 and can be clearly seen in FIG. 5*d*.

The reflector holder 6 itself has a corresponding cylindrical opening, preferably a part-cylinder opening 91, which can be clearly seen in FIG. 4*a*, by means of which part-cylinder opening 91 the reflector holder 6 is mounted rotatably on the cylinder extension 90.

The cylinder extension 90 is arranged on the light source mounting portion 50 of the mounting body 5, more specifically the cylinder extension 90 in the shown variant 3 is arranged on the outer face of the light source mounting portion 50 and the reflector holder 6 engages via the cylinder opening 91 thereof, that is to say via the region receiving the cylinder opening, around the light source mounting portion 50.

The other, first bearing position 80 is formed as a part-sphere receptacle 80 on the plate 52; see FIG. 4 and also FIGS. 5*b* and 6*b*.

The reflector holder 6 in turn has a corresponding part-sphere 81 (see FIG. 4*a*), by means of which it is inserted pivotably into the receptacle 80.

A reflector holder 6, which is formed in one piece with the reflector 3, is also shown in FIG. 6*c* (variant 5). The difference of variant 5 from variant 3 lies merely in the fact that, as will also be discussed briefly later, the cylinder extension 90 is not arranged on the outer side, but on the inner side of the portion 50 of the mounting body 5, and the cylinder opening 91 accordingly is formed slightly differently than in the case of the reflector holder 6 according to variant 3. The upper region with the part-sphere 81, however, is formed identically in both variants.

The reflector holder 6 is now inserted in variants 3 and 5 with the part-sphere 81 into the spherical receptacle 80, and a hook 17 of the plate 52 (see FIG. 6*b*) engages with a slit 17' in the reflector holder 6. This simplifies the assembly, wherein the reflector holder 6 and plate 52 are thus positioned relative to one another to the greatest possible extent, however the reflector holder can still be pivoted about the axis Z.

By means of a screw 10, the reflector holder 6 lastly is screwed through the slot 10" in the plate 52 to the reflector holder 6, which for this purpose has a circular threaded bore 10' (the bore 10' is produced during the course of the injection moulding or is drilled subsequently, then a self-tapping screw is screwed into this bore).

Variant 5

At this juncture reference is made equally to variant 5 (FIGS. 6 and 6*a*-6*c*), which, as already described above, has an identical design to variant 3, with the difference that the cylinder extension 90 is not arranged on the outer side, but on the inner side of the portion 50 of the mounting body 5 and the cylinder opening 91 accordingly is formed slightly differently than in the case of the reflector holder 6 according to variant 3. The upper region with the part-sphere 81, however, is formed identically in both variants.

Here, the "inner" face is the face on which the light source is arranged. In this case, the reflector holder 6 can be easily "fitted" via the cylinder opening 91 thereof onto the cylinder extension during assembly, and the cylinder opening 91 is arranged in practice around the light source 4.

Variant 4

Variant 4 is shown in FIGS. 5 and 5*a*-5*g* and in principle has an identical design to variant 3, wherein it should be noted that the bearing 90 can also be formed internally, as in variant 5.

The key difference from variants 3 and 5 lies in the fact that the reflector 3 and reflector holder 6 are not formed in one piece with one another, but that the pivotable reflector 3 is formed as a component part 7 formed separately from the reflector holder 6, which component part 7 is mounted movably on the reflector holder 6.

In this case the reflecting face 3*a* is thus formed on the component 7 (also referred to as a reflector block 7), and the component part 7 is mounted movably on the reflector holder 6. The advantage of this variant lies in the fact that, besides the pivotability of the reflector holder 6 (and thus of the reflector 3), the reflector 3 is also still adjustable in respect of the reflector holder 6, such that a number of adjustment possibilities are provided.

The reflector 3 or component part 7 is thus mounted on the reflector holder 6 and is movable relative thereto. This relative movement is to be understood primarily to mean a displaceability of the reflector 3 or component part 7 in the vertical direction with respect to the reflector holder 6. However, the reflector 3 or component part 7 may also be mounted on the reflector holder 6 so as to be pivotable relative to the reflector holder 6 about a vertical (Z) axis with respect to the reflector holder 6. A combination of sliding motion and pivoting of the reflector 3 or component part 7 relative to the reflector holder 6 is also theoretically conceivable.

With regard to the mounting of the reflector holder 6 on the mounting body 5, the same comments as made with respect to variants 3 and 5 are applicable, and therefore only the differences produced by the reflector 3/reflector holder 6 separation will be discussed hereinafter.

FIG. 5*e* shows the reflector holder 6, FIG. 5*f* shows the component part 7 (reflector 3), and FIG. 5*g* shows the reflector 3 inserted into the accordingly formed reflector holder 6. The component part 7 is arranged in the reflector holder 6 so as to be adjustable in the vertical direction. The reflector holder 6 has a slot 21', and the component part 7 has a (circular) threaded bore 72 (or the bore 72 is produced during the course of the injection moulding or is drilled subsequently, then a self-tapping screw is screwed into this bore). Via this slot 21' and the bore 72, the component part 7 can be fixed on the reflector holder 6 in various displaced positions using a screw 21.

The extensions 74 on the component part 7 are used as a handle to mechanically adjust the component part 7.

The two extensions 40 are used to pivot the reflector holder 6 and thus the reflector 3 about the Z-axis.

The invention claimed is:

1. A lighting device for a motor vehicle, comprising:

at least one light unit which wherein each light unit comprises a reflector and at least one light source paired with the reflector, wherein light from the at least one light source is emitted into a region in front of the motor vehicle via the corresponding reflector, when the lighting device is in its installed state in the motor vehicle; and at least one mounting body on which the reflector of the least one light unit is arranged so as to be pivotable with respect to the at least one light unit and the at least one mount body about at least one axis paired with the respective reflector and can be fixed in a pivoted position, wherein a reflector holder is provided for each pivotable reflector, which reflector holder is mounted so as to be pivotable with respect to the at least one light unit and the at least one mounting body about the at least one axis, and wherein the pivotable reflector is formed as a component part formed separately from the reflector holder, which component part is mounted movably on the reflector holder.

2. The lighting device of claim 1, wherein the pivotable reflector is fixedly connected to the reflector holder.

3. The lighting device of claim 1, wherein the reflector holder can be fixed in a pivoted position on the mounting body using at least one screw or other fixing means.

4. The lighting device of claim 1, wherein the component part formed separately from the reflector holder can be fixed on the reflector holder using at least one screw or other fixing means.

5. The lighting device of claim 1, wherein the at least one axis is a vertical axis (Z) and the reflector holder is mounted so as to be pivotable about the vertical axis (Z) via a first bearing point and a second bearing point, which are arranged on the mounting body.

6. The lighting device of claim 5, wherein the mounting body has a horizontal light source mounting portion for mounting the at least one light source, a vertical portion extending vertically away from the horizontal light source mounting portion, and at least one further bearing point portion, which extends approximately parallel to the light source mounting portion and on which the at least one bearing point for the at least one reflector holder is arranged, wherein the second bearing point is arranged on the light source mounting portion.

7. The lighting device of claim 5, wherein a bearing point portion is provided for each reflector holder, wherein each bearing point portion has a bearing point for a reflector holder, wherein the bearing point portion is formed as a mounting plate which is separate from the mounting body and which can be fixedly connected to the mounting body in a region facing away from the light source mounting portion of the mounting body.

8. The lighting device of claim 1, wherein at least one fixing screw or other fixing means is mounted rotatably in at least one bearing point portion, by means of which fixing screw or other fixing means the reflector holder can be fixed in a position pivoted about a vertical axis (Z).

9. The lighting device of claim 1, wherein the component part separate from the reflector holder is mounted in the reflector holder so as to be displaceable in the vertical direction.

10. The lighting device of claim 9, wherein at least one fixing screw or other fixing means is provided, by means of which fixing screw or other fixing means the component part can be fixed on the reflector holder.

11. The lighting device of claim 1, wherein the at least one light source of the at least one light unit comprises at least one light-emitting diode.

12. The lighting device of claim 1, wherein the at least one axis about which the reflector is pivotable is a vertical axis (Z) and runs through the light source.

13. The lighting device of claim 1, wherein the mounting body is formed as a heat sink for the at least one light source.

14. A headlight for a motor vehicle, comprising at least one lighting device of claim 1.

15. A headlight system having a left and a right headlight of claim 14 for producing an overall light distribution.

16. The headlight system of claim 15, wherein the left headlight produces the left part of the overall light distribution and the right headlight produces the right part of the overall light distribution, wherein the left and the right part of the overall light distribution preferably overlap in the middle, as viewed in the horizontal direction.

17. The lighting device of claim 1, wherein the at least one light unit comprises two or more lighting units.

18. The lighting device of claim 17, wherein two or more of the reflectors of the two or more lighting units are mounted on the at least one mounting body.

19. A lighting device for a motor vehicle, comprising:

at least one light unit which wherein each light unit comprises a reflector and at least one light source paired with the reflector, wherein light from the at least one light source is emitted into a region in front of the motor vehicle via the corresponding reflector, when the lighting device is in its installed state in the motor vehicle; and at least one mounting body on which the least one light unit is arranged so as to be pivotable about at least one axis paired with the respective reflector and can be fixed in a pivoted position, wherein a reflector holder is provided for each pivotable reflector, which reflector holder is mounted so as to be pivotable with respect to the at least one mounting body about the at least one axis, and wherein the pivotable reflector is formed as a component part formed separately from the reflector holder, which component part is mounted movably on the reflector holder, wherein the at least one axis is a vertical axis (Z) and the reflector holder is mounted so as to be pivotable about the vertical axis (Z) via a first bearing point and a second bearing point, which are arranged on the mounting body, wherein a bearing point for the reflector holder is formed as a cylinder extension and the reflector holder has a corresponding cylindrical opening, by means of which the reflector holder is mounted rotatably on the cylinder extension.

20. The lighting device of claim 19, wherein the cylindrical opening is a part-cylinder opening and wherein the cylinder extension is arranged on an inner face of the light source mounting portion or of the bearing point portion, or the cylinder extension is arranged on an outer face either of the light source mounting portion or of the bearing point portion, and the reflector holder engages around the light source mounting portion via the part-cylinder opening.

21. The lighting device of claim 19, wherein a bearing point is formed as a part-sphere receptacle (89)/part-sphere on the mounting body (5), in particular on the light source mounting portion, or preferably is formed on the bearing point portion (52), and a part-sphere (81)/part-sphere receptacle for the first-mentioned part-sphere receptacle (89)/part-sphere is formed on the reflector holder, wherein the part-sphere receptacle (89)/part-sphere is preferably arranged on an inner face of the light source mounting portion (50) or of the bearing point portion.

22. A lighting device for a motor vehicle, comprising:

at least one light unit which wherein each light unit comprises a reflector and at least one light source paired with the reflector, wherein light from the at least one light source is emitted into a region in front of the motor vehicle via the corresponding reflector, when the lighting device is in its installed state in the motor vehicle; and at least one mounting body on which the least one light unit is arranged so as to be pivotable about at least one axis paired with the respective reflector and can be fixed in a pivoted position, wherein a reflector holder is provided for each pivotable reflector, which reflector holder is mounted so as to be pivotable with respect to the at least one mounting body about the at least one axis and wherein the pivotable reflector is formed as a component part formed separately from the reflector holder, which component part is mounted movably on the reflector holder, wherein the reflector holder is mounted on a carrier element so as to be pivotable with respect to the mounting body about at least one axis, and wherein the carrier element has a two-part design and comprises (i) an L-shaped mounting bracket (60), which mounting bracket can be attached on a light source mounting portion of the mounting body and is connectable to a second vertical portion of the mounting body extending away from the horizontal light source mounting portion substantially vertically, and (ii) an L-shaped mounting bracket (61), which can be fastened to a substantially vertical portion (60*a*) of the mounting bracket (60), and which mounting bracket (61) has a substantially horizontal retaining bracket portion (61*b*), on which the reflector is mounted pivotably about the vertical axis (Z) and can be fixed in a pivoted position by means of a fixing means (10).

23. The lighting device of claim 22, wherein the retaining bracket (61) can be displaced in the vertical direction with respect to the mounting bracket (60) and can be fixed in a position using a fixing means (20), wherein the mounting bracket (60) preferably can be attached to the light source mounting portion (50) of the mounting body (5) so as to be pivotable about a horizontal axis (Y) arranged transversely to the light exit direction.

* * * * *